US009128462B2

(12) United States Patent
Maffioli et al.

(10) Patent No.: US 9,128,462 B2
(45) Date of Patent: Sep. 8, 2015

(54) BALANCE INERTIA ADJUSTING SCREW AND BALANCE COMPRISING SUCH A SCREW

(71) Applicant: MONTRES TUDOR S.A., Geneva (CH)

(72) Inventors: Sacha Maffioli, Veigy-Foncenex (FR); Eric Guffond, Mont-Saxonnex (FR)

(73) Assignee: MONTRES TUDOR S.A., Geneva (CH)

( * ) Notice: Subject to any disclaimer, the term of this patent is extended or adjusted under 35 U.S.C. 154(b) by 0 days.

(21) Appl. No.: 14/137,191

(22) Filed: Dec. 20, 2013

(65) Prior Publication Data

US 2014/0177398 A1 Jun. 26, 2014

(30) Foreign Application Priority Data

Dec. 21, 2012 (EP) ..... 12199213

(51) Int. Cl.
*G04B 18/04* (2006.01)
*G04B 18/00* (2006.01)

(52) U.S. Cl.
CPC ..... *G04B 18/006* (2013.01); *G04B 18/04* (2013.01)

(58) Field of Classification Search
CPC .... G04B 18/023; G04B 18/02; G04B 18/021; G04B 18/025; G04B 18/00; G04B 19/00
USPC ..... 368/173, 170–171
See application file for complete search history.

(56) References Cited

U.S. PATENT DOCUMENTS

| | | | | |
|---|---|---|---|---|
| 510,202 | A * | 12/1893 | Smith | 368/171 |
| 2,665,546 | A | 1/1954 | Van Haaften | |
| 3,418,801 | A * | 12/1968 | Marti | 368/168 |
| 7,216,595 | B2 * | 5/2007 | Steiner | 111/99 |
| 2007/0222276 | A1 * | 9/2007 | Verardo et al. | 301/12.1 |
| 2011/0136077 | A1 * | 6/2011 | De Moyer | 433/173 |
| 2011/0224486 | A1 * | 9/2011 | Nguyen et al. | 600/106 |
| 2012/0129126 | A1 * | 5/2012 | Nouriam et al. | 433/75 |
| 2013/0309632 | A1 * | 11/2013 | Sanders | 433/174 |

FOREIGN PATENT DOCUMENTS

| | | |
|---|---|---|
| CH | 196706 | 6/1938 |
| CH | 264669 | 1/1950 |
| EP | 1837719 A1 | 9/2007 |
| EP | 1837719 B1 | 6/2009 |
| EP | 2410386 A1 | 1/2012 |
| FR | 1274565 | 9/1961 |

OTHER PUBLICATIONS

European Search Report dated Jun. 25, 2013, issued in corresponding European application No. EP12199213.

* cited by examiner

*Primary Examiner* — Sean Kayes
(74) *Attorney, Agent, or Firm* — Westerman, Hattori, Daniels & Adrian, LLP

(57) ABSTRACT

An adjusting screw (1), particularly a screw for adjusting the inertia of a balance (2) of a clockwork oscillator, the screw comprising a longitudinal axis (3), this screw also comprising a first set (A0) of at least one reference (A1, A2, A3) for indicating the longitudinal position of the screw with respect to a member, notably the balance, into which the screw is screwed.

26 Claims, 3 Drawing Sheets

BALANCE INERTIA ADJUSTING SCREW AND BALANCE COMPRISING SUCH A SCREW

BACKGROUND ART

The invention relates to an adjusting screw, notably to a screw for adjusting the inertia of a balance of a clockwork oscillator. It also relates to a clockwork balance comprising at least one such adjusting screw. The invention finally relates to a clockwork movement or to a timepiece, notably a watch, comprising such a balance or such an adjusting screw.

A balance the moment of inertia of which can be adjusted using adjusting screws arranged at its periphery is known. This type of device is notably known in its use within mechanical oscillators of which the basic frequency of the oscillator is adjusted through the moment of inertia of the balance. In general, such a balance comprises a felloe, arms and a certain arrangement of screws or balance weights fixed to the felloe of the balance and which, by adjusting their positions, can be used to alter the moment of inertia of the balance. These elements might have different masses so as to allow fairly fine adjustment of the running of the clockwork movement. These screws or balance weights are positioned using keys or screwdrivers that allow their position to be adjusted. These tools are generally provided with means that provide an indication of the screwing-in or the backing-off of the screw or of the balance weight with respect to the balance felloe. However, once this operation has been performed, it is no longer possible to determine the position of the balance weights.

Patent CH196706 relates to a variable-inertia balance which is provided with adjusting screws which are screwed from the outside of the balance felloe, making for easier adjustment and minimizing the risk of marking the balance felloe. This balance is one wherein the felloe has recesses to house the screw heads. Thus, the screw heads can easily be turned and do not project out from the felloe. However, the recesses made in the felloe carry the risk of having a negative interaction with any balance stop spring that might come into contact with the balance felloe.

Patent CH264669 relates to a balance provided with headless adjusting screws which are screwed from the outside of the balance felloe and sunk into the thickness thereof. This embodiment seeks advantageously to replace balances equipped with screws with heads that either protrude from the periphery of the felloe or are housed in a recess in the felloe.

Patent EP1837719B1 discloses a balance felloe comprising spurs of materials directed radially towards the inside of the balance, through each of which there passes a tapped hole to accommodate balance weights which are screwed in from the inside of the balance. In this configuration, it is awkward to grasp hold of the balance weights and there is a risk that the balance felloe will thus become marked during adjustment.

SUMMARY OF THE INVENTION

It is an object of the invention to provide adjusting screws that overcome the abovementioned problem and improve on the screws known from the prior art. In particular, the invention proposes a screw that will allow a clockmaker to determine or assess the position occupied by this screw in relation to the balance felloe into which the screw is screwed. The invention also relates to a balance comprising such a screw or even to a movement comprising such a balance, or even to a timepiece comprising such a movement.

A screw according to the invention is an adjusting screw, particularly a screw for adjusting the inertia of a balance of a clockwork oscillator, the screw comprising a longitudinal axis, this screw also comprising a first set of at least one reference for indicating the longitudinal position of the screw with respect to a member, notably the balance, into which the screw is screwed.

Various embodiments of the screw are as follows:

- the reference for indicating the longitudinal position of the screw is at least substantially located in a plane perpendicular to the longitudinal axis,
- the reference or references for indicating the longitudinal position of the screw each comprise a continuous or discontinuous annular mark extending at the periphery of the screw,
- the mark comprises a groove and/or a shoulder and/or an impression,
- the mark is formed on the body of the screw, notably on a cylindrical or substantially cylindrical part of the body,
- the first set comprises several references for indicating the longitudinal position of the screw, notably two, three, four, five or six references for indicating the longitudinal position of the screw, uniformly or substantially uniformly distributed longitudinally,
- the distance separating two adjacent references for indicating the longitudinal position of the screw is a multiple of the pitch of the screw, notably equal to the pitch of the screw,
- the screw comprises a second set of at least one reference for indicating the angular position of the screw about the longitudinal axis with respect to the member, notably the balance, into which the screw is screwed,
- the second set comprises several references for indicating the angular position of the screw, notably two, three, four, five or six references for indicating the angular position of the screw, uniformly or substantially uniformly distributed angularly about the longitudinal axis,
- the references for indicating the angular position of the screw are at least substantially located in a plane perpendicular to the longitudinal axis,
- the reference or references for indicating the angular position of the screw each comprise a milling and/or an impression,
- the adjusting screw comprises a driving socket for turning the screw and an element for guiding the screw, notably a bore.

A balance according to the invention is a clockwork balance comprising at least one such adjusting screw.

A clockwork movement according to the invention comprises such a balance.

A timepiece according to the invention is a timepiece, notably a watch, comprising such a movement.

BRIEF DESCRIPTION OF THE DRAWINGS

The attached drawings depict, by way of example, one embodiment of a screw according to the invention.

DETAILED DESCRIPTION OF PARTICULAR EMBODIMENTS

Figure 1:
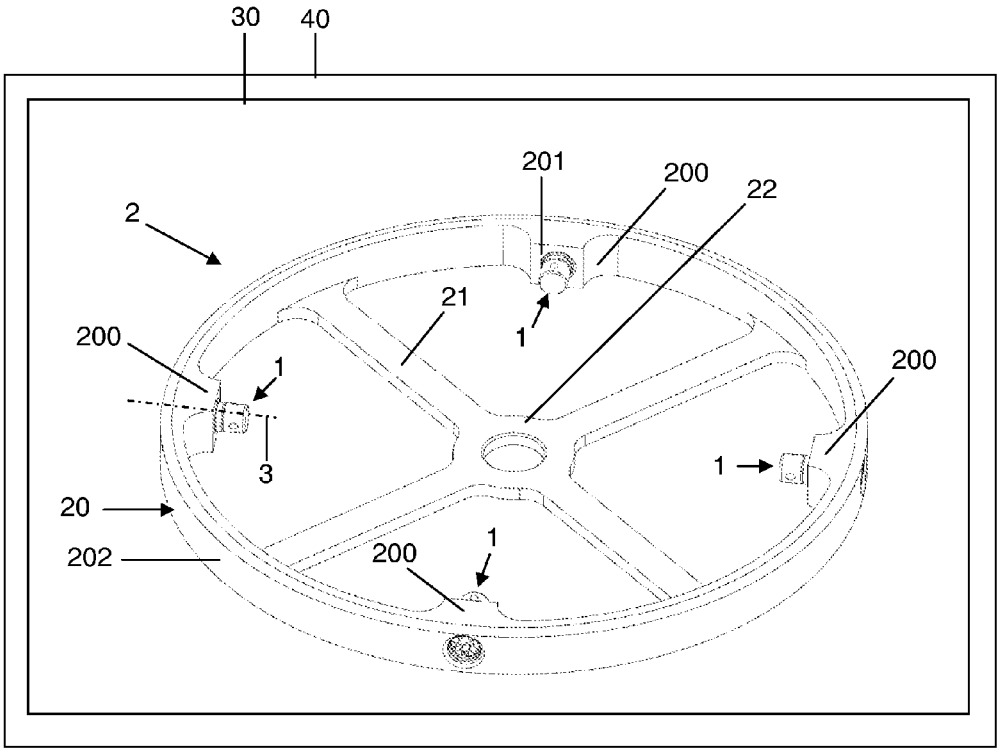
FIG. 1 is a perspective view of an embodiment of a timepiece according to the invention.
Figure 2:
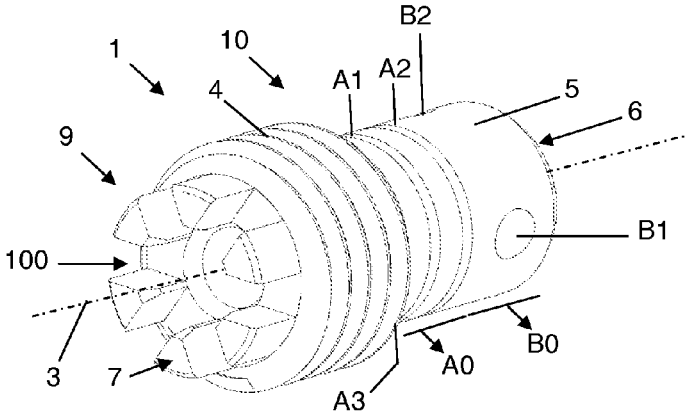
FIG. 2 is a perspective view of an embodiment of a screw according to the invention, viewed from a first end of the screw.
Figure 3:
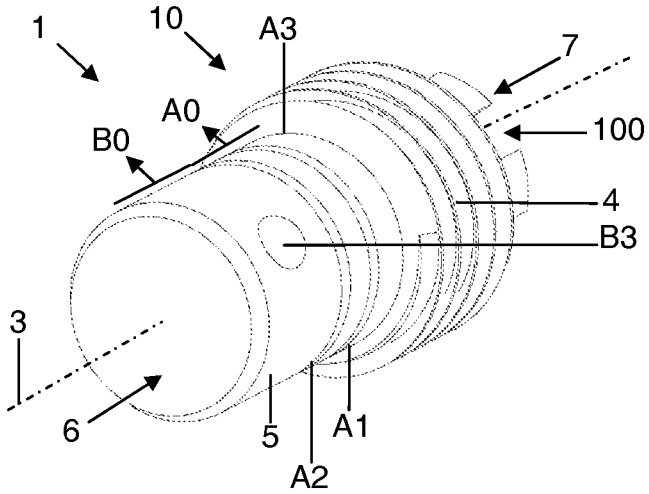
FIG. 3 is a perspective view of the embodiment of the screw according to the invention, viewed from the other end of the screw.

One embodiment of a timepiece 40 is described hereinafter with reference to FIG. 1. The timepiece is, for example, a watch, notably a wrist watch. The timepiece includes a mechanical clock movement 30. This movement itself comprises an oscillator including a balance 2 and a return spring, notably a hairspring (not depicted in FIG. 1).

The balance mainly comprises a felloe 20, a hub 22 through which a bore passes and spokes 21 mechanically connecting the felloe to the hub. The balance may for example have four spokes.

Advantageously, the felloe has spurs 200 or thicker portions through each of which a tapped hole 8 passes. The tapped holes are preferably oriented radially. Each hole is intended to accommodate a screw 1. The spurs allow tapped holes to be provided that extend over a long enough length to guide the screws therein or hold them correctly. The spurs extend between the external surface 202 of the felloe and an internal surface 201, for example a plane perpendicular to the axis 3. For example, the balance has four spurs 200 each one accepting a screw 1. With preference, the spurs 200 and the tapped holes are evenly distributed between the spokes of the balance or where the spokes meet the felloe. In this way, for a given outside diameter of balance, for a given cross section of felloe, the length of the tapped hole can be maximized.

The balance is therefore of the type having a moment of inertia that can be adjusted by the adjustment screws 1 which are arranged at its periphery. Thus, by altering the extent to which the screws are screwed into the felloe, the basic frequency of the oscillator is adjusted via the moment of inertia of the balance. It is by adjusting the positions of the screws that the moment of inertia of the balance is altered. The running of the clockwork movement can thus be adjusted fairly finely. These screws are positioned using keys or screwdrivers that can be used to adjust their position.

One embodiment of an adjusting screw 1 is described hereinafter with reference to FIGS. 2 to 6. Between a first end 6 and a second end 7 the screw comprises a head 9 and a body 10. The body comprises a threaded first part 4 and a cylindrical or substantially cylindrical second part 5 which is not threaded. For preference, these adjusting screws are four in number. They are advantageously made of a dense material such as gold or platinum. The head 9 has a driving socket 100 designed to calibrate with an at least partially complementary shape on a tool so as to allow a clockmaker to turn the screw using the tool. In the embodiment illustrated in FIGS. 2 to 6, the diameter of the head 9 is substantially equivalent to that of the body 10 of the screw, notably of the cylindrical part 5 of the body 10 of the screw. As an alternative, the diameter of the head 9 may differ from that of the body 10. For preference, the diameter of the cylindrical part 5 is of the same order as that of the threaded part 4 of the body 10 of the screw.

The screw has a longitudinal axis 3. It comprises a first set A0 of at least one reference A1, A2, A3 for indicating the longitudinal position of the screw with respect to the balance into which the screw is screwed. In the embodiment depicted, the first set comprises a first reference A1 for indicating the longitudinal position of the screw, a second reference A2 for indicating the longitudinal position of the screw, and a third reference A3 for indicating the longitudinal position of the screw.

The first reference A1 for indicating the longitudinal position of the screw is located or substantially located in a plane P1 perpendicular to the longitudinal axis of the screw. The second reference A2 for indicating the longitudinal position of the screw is located or substantially located in a plane perpendicular to the longitudinal axis of the screw and parallel to the plane P1. The third reference A3 for indicating the longitudinal position of the screw is located or substantially located in a plane perpendicular to the longitudinal axis of the screw and parallel to the plane P1.

The first reference A1 for indicating the longitudinal position of the screw comprises a continuous or discontinuous first annular mark extending at the periphery of the screw, notably all around the screw. The second reference A2 for indicating the longitudinal position of the screw comprises a continuous or discontinuous second annular mark extending at the periphery of the screw, notably all around the screw. The third reference A3 for indicating the longitudinal position of the screw comprises a continuous or discontinuous third annular mark extending at the periphery of the screw, notably all around the screw.

The first mark and/or the second mark and/or the third mark may comprise a groove, an impression or a shoulder. The first and second marks here comprise a groove. The third mark here comprises a shoulder, notably a shoulder marking the end of the screw thread.

The first mark and/or the second mark and/or the third mark is formed on the body 10 of the screw 1. In particular, the first mark and/or the second mark is formed on a cylindrical part 5 adjoining the threaded part 4. In particular, the third mark is formed at one end of the cylindrical part 5 adjoining the threaded part 4.

On the screw depicted in FIGS. 2 to 6, the first set A0 comprises a first reference for indicating the longitudinal position of the screw, a second reference for indicating the longitudinal position of the screw, and a third reference for indicating the longitudinal position of the screw. However, the first set may comprise two, four, five or six references for indicating the longitudinal position of the screw. The references for indicating the longitudinal position of the screw are uniformly or substantially uniformly distributed longitudinally. Advantageously, the distance separating two adjacent references for indicating the longitudinal position of the screw is a multiple of the pitch of the screw, notably equal to the pitch of the screw.

The screw comprises a second set B0 of at least one reference B1, B2, B3 for indicating the angular position of the screw about the longitudinal axis with respect to the balance into which the screw is screwed. In the embodiment depicted, the second set comprises a first reference B1 for indicating the angular position of the screw, a second reference B2 for indicating the angular position of the screw and a third reference B3 for indicating the angular position of the screw.

On the screw depicted in FIGS. 2 to 6, the second set comprises three references for indicating the angular position of the screw. However, the second set may comprise two, four, five or six references for indicating the angular position of the screw. The references for indicating the angular position of the screw are uniformly or substantially uniformly distributed about the longitudinal axis of the screw.

For preference, the references for indicating the angular position of the screw are at least substantially located in a plane P2 perpendicular to the longitudinal axis 3 and are formed on the body 10 of the screw 1, notably on a cylindrical part 5 adjoining the threaded part 4.

The references for indicating the angular position of the screw each comprise a milling and/or an impression. The references for indicating the angular position of the screw may each consist of a marking, for example a marking of a numeral. The first, second and third marks here comprise a milling.

The screw head comprises, in addition to the driving socket 100 for turning it, an element 1000 for guiding the screw, notably a bore 1000. This guide element allows the screw to be fitted onto the end of a tool so as to guide this screw into a tapped hole intended to accept it. The screw can preferably be turned from the outside of the felloe 20 of the balance 2. Once the screw is in place, the head is sunk into a spur and the body 10 is partially sunk into the thickness of a spur of the balance felloe. The screw can also be fitted from the inside of the felloe.

Figure 4:
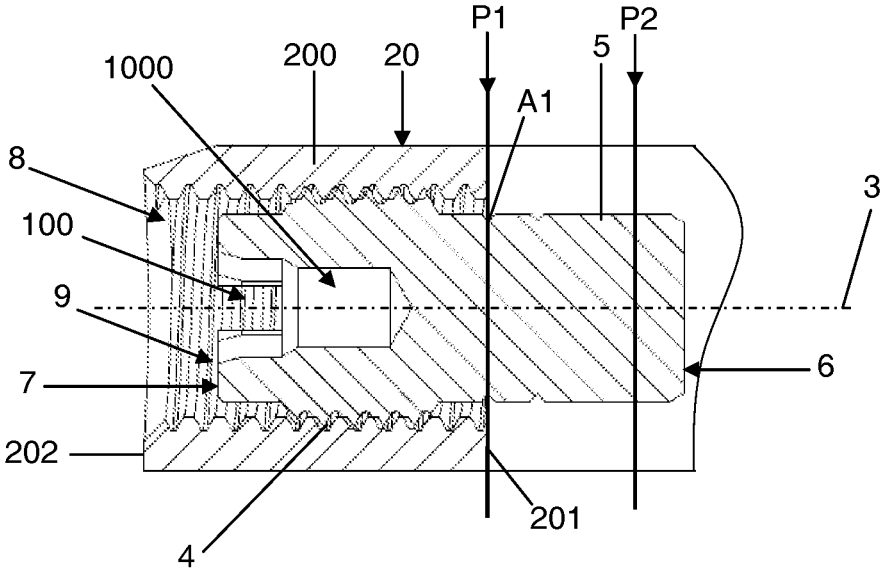
FIG. 4 is a view in partial section of the balance and of a screw according to the invention along the longitudinal axis of the screw, the screw being in place in the felloe in a first configuration.
Figure 5:
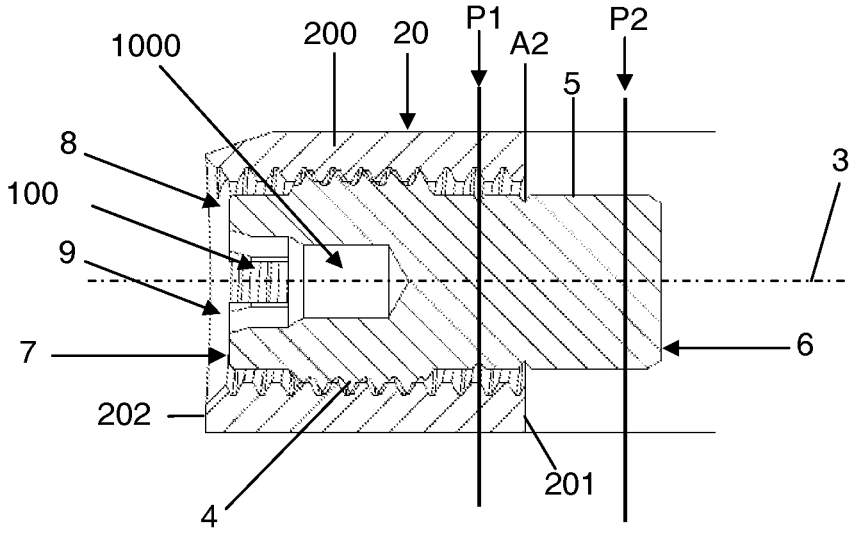
FIG. 5 is a view in partial section of the balance and of a screw according to the invention along the longitudinal axis of the screw, the screw being in place in the felloe in a second configuration.
Figure 6:
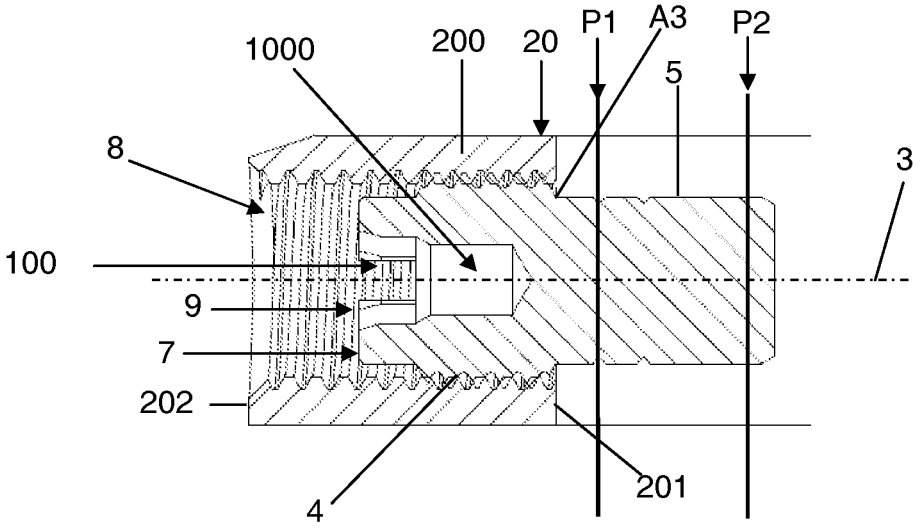
FIG. 6 is a view in partial section of the balance and of a screw according to the invention along the longitudinal axis of the screw, the screw being in place in the felloe in a third configuration.

The first set for example comprises two references A2, A3 intended to indicate the permissible amount of longitudinal movement of the screw with respect to the balance. The longitudinal position of the screw is preferably read using the references in conjunction with the face 201 of the spur. FIGS. 4 to 6 depict the screw in various positions in which a reference coincides with this face 201. The clockmaker carrying out an adjustment operation can, from such information, determine the position of the screw relative to the balance. Moreover, it may be known to the clockmaker that moving the screw from a position in which one reference of the screw coincides with the face 201 into a position in which another reference of the screw coincides with the face 201 gives rise to a determined variation in the inertia of the balance or to a determined variation in the running. For preference, a reference A1 indicates the nominal position of the screw with respect to the felloe, notably with respect to the face 201 of the spur of the felloe as depicted in FIG. 4. Thus, prior to the adjustment operation, each of the screws may be ideally positioned in this configuration. The reference A2 indicates the position that the screw is to adopt with respect to the felloe, notably with respect to the face 201 of the spur of the felloe as depicted in FIG. 5, in order to maximize the moment of inertia of the balance and thus maximize the slowing of the oscillator for a given range of adjustment. Finally, the reference A3 indicates the position that the screw is to adopt with respect to the felloe, notably with respect to the face 201 of the spur of the felloe as depicted in FIG. 6, in order to minimize the moment of inertia of the balance and thus maximize the advance of the oscillator for a given range of adjustment.

The angular position of the screw is read by the appearance and disappearance of the references for indicating the angular position of the screw as the screw turns. Because the connection between the screw and the felloe is of the helicoidal type, a given longitudinal movement of the screw corresponds to a given angular movement of the screw.

In the embodiment described hereinabove, the first and second sets are produced on two distinct and adjacent regions of the screw. However, the arrangement could be different. Notably the first and second sets could be produced on one and the same region of the screw body.

As an alternative, it is conceivable to form markings mentioned above on a screw which is provided with a head designed to be housed within a recess of the exterior periphery of the balance felloe. It is also possible to form these markings on a screw that can be turned from the internal periphery of the balance felloe.

In the various alternative forms, the socket 100 of the screw is preferably a hexagon socket to make it easier for the screw to be grasped and turned using a suitable tool. This socket is advantageously combined with a bore 1000 designed to collaborate with this same tool and thus provide ease of guidance of the screw into the tapped hole dedicated to it.

The invention makes it possible to obtain a variable-inertia balance the screw adjustment of which is particularly simple because the screws are arranged facing the balance felloe, and because of their geometry which is designed to make them easier to adjust using a suitable tool. The references indicate a permissible range of adjustment and also provide information regarding the amount of movement of the screw during adjustment.

The adjusting screws according to the invention make the adjusting operation easier. Such a solution is particularly advantageous with respect to its simplicity of use.

Preferably, in the different modes of implementation and embodiments, references for indicating the longitudinal position and/or the angular position of the screw with respect to a member are elements that are separate from essential and/or functional elements of the screw, as including the threads, the head, the head base or shoulder or the driving recess. Thus, references for indicating the longitudinal position and/or the angular position of the screw in the member are specific elements, as marks or markings, the function of which or the sole function of which is to indicate the position of the screw. This indication is possible in cooperation with elements on the member.

In the different modes of implementation and embodiments, the tapped holes made in the balance are blind tapped holes or through tapped holes. Preferably, the tapped holes are fully carried out in the material of the balance over a full 360° revolution, i.e. they have no lateral opening and, in particular, no lateral opening designed to cooperate with a reference on a screw to indicate a position of the screw relatively to the balance.

In the known prior art, there is no simple means of locating the screws facing the felloe. Moreover, the screws are not easy to turn and there is a risk of marking the balance felloe during adjustment. Thanks to the invention, the clockmaker can be informed of the fractions of screw turn he has performed during adjustment. Such markings contribute toward making the adjustment operation easier. Thus, the invention proposes a variable-inertia balance the adjusting screws of which carry information. Moreover, these screws are configured and positioned in such a way as to simplify the adjusting operations as far as possible.

The invention claimed is:

1. An adjusting screw comprising:

a longitudinal axis, and at least one longitudinal position reference for indicating a longitudinal position of the screw with respect to a member into which the screw is to be screwed, wherein the sole function of the at least one longitudinal position reference is to indicate the longitudinal position of the screw with respect to the member into which the screw is to be screwed, wherein the screw is a screw for adjusting the inertia of a balance, and wherein the at least one longitudinal position reference is for indicating the longitudinal position of the screw with respect to the balance.

2. The adjusting screw as claimed in claim 1, wherein the at least one longitudinal position reference for indicating the longitudinal position of the screw is at least substantially located in a plane perpendicular to the longitudinal axis.

3. The adjusting screw as claimed in claim 1, wherein the at least one longitudinal position reference for indicating the longitudinal position of the screw comprises a continuous or discontinuous annular mark extending at the periphery of the screw.

4. The adjusting screw as claimed in claim 3, wherein the mark comprises at least one of a groove, a shoulder and an impression.

5. The adjusting screw as claimed in claim 3, wherein the mark is formed on a body of the screw.

6. The adjusting screw as claimed in claim 1, wherein the screw comprises a plurality of longitudinal position references for indicating the longitudinal position of the screw, and the plurality of longitudinal position references are uniformly or substantially uniformly distributed longitudinally.

7. The adjusting screw as claimed in claim 6, wherein a distance separating two adjacent longitudinal position references for indicating the longitudinal position of the screw is a multiple of a pitch of the screw.

8. The adjusting screw as claimed in claim 1, wherein the screw comprises at least one angular position reference for indicating an angular position of the screw about the longitudinal axis with respect to the member into which the screw is screwed.

9. The adjusting screw as claimed in claim 8, wherein the screw comprises a plurality of angular position references for indicating the angular position of the screw, and the plurality of angular position references are uniformly or substantially uniformly distributed angularly about the longitudinal axis.

10. The adjusting screw as claimed in claim 8, wherein the at least one angular position reference for indicating the angular position of the screw is at least substantially located in a plane perpendicular to the longitudinal axis.

11. The adjusting screw as claimed in claim 8, wherein the at least one angular position reference for indicating the angular position of the screw comprises at least one of a milling and an impression.

12. The adjusting screw as claimed in claim 8, wherein the sole function of the at least one angular position reference is to indicate the angular position of the screw about the longitudinal axis with respect to the member into which the screw is to be screwed.

13. A clockwork balance comprising at least one adjusting screw as claimed in claim 12.

14. The adjusting screw as claimed in claim 8, wherein the screw comprises a head configured to be turned for screwing the screw and a body that has a threaded portion for screwing the screw in the member, and wherein the at least one angular position reference is located on the portion of the body opposite the head relative to the threaded portion.

15. The adjusting screw as claimed in claim 1, which comprises a driving socket for turning the screw and an element for guiding the screw.

16. A clockwork balance comprising at least one adjusting screw as claimed in claim 1.

17. The clockwork balance as claimed in claim 16, wherein the balance comprises a tapped hole into which the screw is screwed, and wherein the tapped hole extends along a longitudinal direction of the tapped hole from an opening on a surface of the balance at a first end of the tapped hole to a second end opposite the opening, and the tapped hole has no lateral opening on a surface of the balance between the first end and the second end.

18. A movement comprising the balance as claimed in claim 16.

19. The adjusting screw as claimed in claim 1, wherein the screw comprises a head configured to be turned for screwing the screw and a body that has a threaded portion for screwing the screw in the member, and wherein the at least one longitudinal position reference is located on a portion of the body opposite the head relative to the threaded portion.

20. A clockwork balance comprising at least one adjusting screw, said adjusting screw comprising:

a longitudinal axis, at least one longitudinal position reference for indicating a longitudinal position of the screw with respect to a member into which the screw is to be screwed, wherein the sole function of the at least one longitudinal position reference is to indicate the longitudinal position of the screw with respect to the member into which the screw is to be screwed.

21. A movement comprising the balance as claimed in claim 20.

22. The clockwork balance as claimed in claim 20, wherein the balance comprises a tapped hole into which the screw is screwed, and wherein the tapped hole extends along a longitudinal direction of the tapped hole from an opening on a surface of the balance at a first end of the tapped hole to a second end opposite the opening, and the tapped hole has no lateral opening on a surface of the balance between the first end and the second end.

23. An adjusting screw, comprising:

a longitudinal axis, at least one longitudinal position reference for indicating a longitudinal position of the screw with respect to a member into which the screw is to be screwed, and at least one angular position reference for indicating an angular position of the screw about the longitudinal axis with respect to the member into which the screw is screwed, wherein the sole function of the at least one longitudinal position reference is to indicate the longitudinal position of the screw with respect to the member into which the screw is to be screwed, and wherein the sole function of the at least one angular position reference is to indicate the angular position of the screw about the longitudinal axis with respect to the member into which the screw is to be screwed.

24. A clockwork balance comprising at least one adjusting screw as claimed in claim 23.

25. An adjusting screw comprising:

a longitudinal axis, at least one longitudinal position reference for indicating a longitudinal position of the screw with respect to a member into which the screw is to be screwed, wherein the sole function of the at least one longitudinal position reference is to indicate the longitudinal position of the screw with respect to the member into which the screw is to be screwed, wherein the screw comprises a head configured to be turned for screwing the screw and a body that has a threaded portion for screwing the screw in the member, and wherein the at least one longitudinal position reference is located on a portion of the body opposite the head relative to the threaded portion.

26. An adjusting screw comprising:

a longitudinal axis, at least one longitudinal position reference for indicating a longitudinal position of the screw with respect to a member into which the screw is to be screwed, and at least one angular position reference for indicating the angular position of the screw about the longitudinal axis with respect to the member into which the screw is screwed, wherein the sole function of the at least one longitudinal position reference is to indicate the longitudinal position of the screw with respect to the member into which the screw is to be screwed, wherein the screw comprises a head configured to be turned for screwing the screw and a body that has a threaded portion for screwing the screw in the member, and wherein the at least one angular position reference is located on the portion of the body opposite the head relative to the threaded portion.

* * * * *